US010334932B1

(12) United States Patent
Huang

(10) Patent No.: US 10,334,932 B1
(45) Date of Patent: Jul. 2, 2019

(54) LIGHTENING COSMETIC CONTAINER

(71) Applicant: HUANIYA INTERNATIONAL CO., LTD., Taichung (TW)

(72) Inventor: Jung-Hui Huang, Taichung (TW)

(73) Assignee: HUANIYA INTERNATIONAL CO., LTD., Taichung (TW)

( * ) Notice: Subject to any disclaimer, the term of this patent is extended or adjusted under 35 U.S.C. 154(b) by 0 days.

(21) Appl. No.: 16/106,995

(22) Filed: Aug. 21, 2018

(51) Int. Cl.
*A45D 33/00* (2006.01)
*A45D 33/32* (2006.01)
*A45D 40/22* (2006.01)

(52) U.S. Cl.
CPC ..... *A45D 33/32* (2013.01); *A45D 33/006* (2013.01); *A45D 33/008* (2013.01); *A45D 40/222* (2013.01)

(58) Field of Classification Search
CPC .... A45D 33/32; A45D 33/008; A45D 33/006; A45D 40/222; A47G 1/16; A47G 2001/002
See application file for complete search history.

(56) References Cited

U.S. PATENT DOCUMENTS

2003/0010351 A1* 1/2003 de Laforcade ..... A45D 40/222 132/294
2006/0096611 A1* 5/2006 Leppla ..... A45D 33/006 132/294
2006/0250795 A1* 11/2006 Langone ..... A61L 9/14 362/253
2012/0279516 A1* 11/2012 Bouix ..... A45D 33/008 132/301
2017/0086560 A1* 3/2017 Pires ..... A45D 33/32
2018/0116367 A1* 5/2018 Matsuura ..... A45D 33/008
2018/0360192 A1* 12/2018 Matsui ..... A45D 33/006
2019/0082807 A1* 3/2019 Liu ..... A45D 33/32

* cited by examiner

*Primary Examiner* — Joseph L Williams
*Assistant Examiner* — Jose M Diaz
(74) *Attorney, Agent, or Firm* — Muncy, Geissler, Olds & Lowe, P.C.

(57) ABSTRACT

A lightening cosmetic container is provided, including: a main body and a lightening device. The main body includes a case, a cover and an attachment member. The cover has an inner surface including at least one recession disposed thereon. The attachment member is attached to the inner surface by an adhesive material and covers at least part of the at least one recession within which the adhesive material comes. The lightening device is disposed on the main body and includes at least one light source, a magnetic switch which is electrically connected with the at least one light source, and a magnetic member disposed corresponding to the magnetic switch. The cover is openable relative to the case to change magnetic state of the magnetic switch and switch the magnetic switch on.

20 Claims, 8 Drawing Sheets

LIGHTENING COSMETIC CONTAINER

BACKGROUND OF THE INVENTION

Field of the Invention

The present invention relates to a lightening cosmetic container.

Description of the Prior Art

A conventional cosmetic container usually includes a mirror and at least a kind of cosmetic and is portable to maintain integrity of makeup. The conventional cosmetic container has lightening function to be used in low-light environment. However, brightness of a light source of the cosmetic container is insufficient, and a switch of the light source is a hand-switched mechanical switch and usually exposed outwardly, which is easy to be switched inadvertently and damaged by collision.

The present invention is, therefore, arisen to obviate or at least mitigate the above-mentioned disadvantages.

SUMMARY OF THE INVENTION

The main object of the present invention is to provide a lightening cosmetic container, whose lighting switch is switchable by magnetic induction.

To achieve the above and other objects, the present invention provides a lightening cosmetic container, including: a main body and a lightening device. The main body includes a case, a cover and an attachment member. The cover has an inner surface including at least one recession disposed thereon. The attachment member is attached to the inner surface by an adhesive material and covers at least part of the at least one recession within which the adhesive material comes. The lightening device is disposed on the main body and includes at least one light source, a magnetic switch which is electrically connected with the at least one light source, and a magnetic member disposed corresponding to the magnetic switch. Wherein the cover is openable relative to the case to change magnetic state of the magnetic switch and switch the magnetic switch on.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
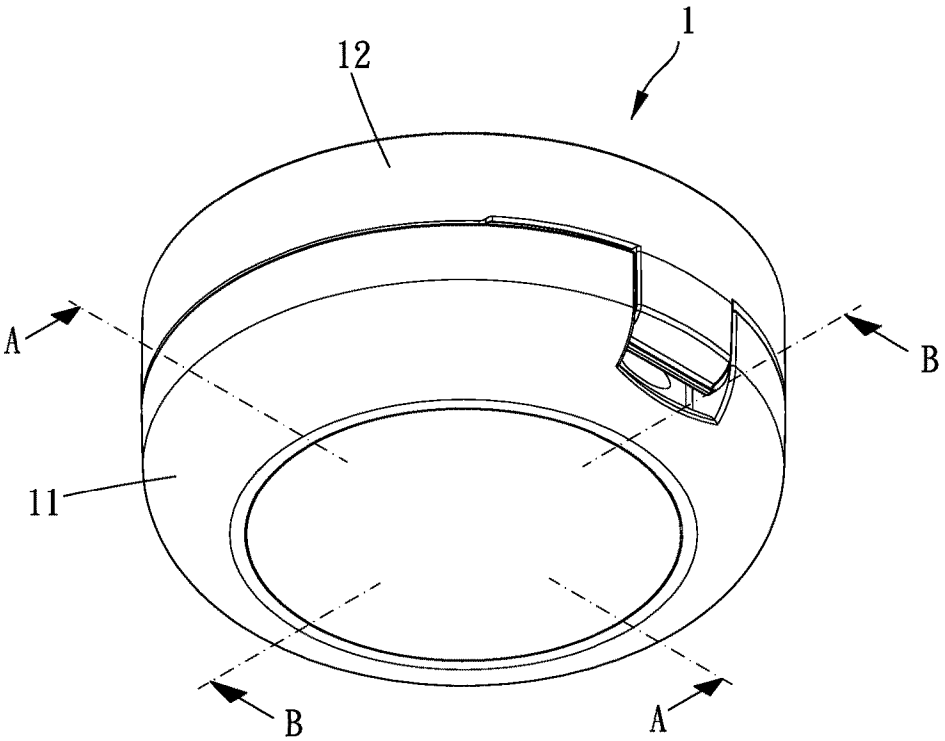
FIGS. 1 and 2 are stereograms of a preferable embodiment of the present invention.
Figure 2:
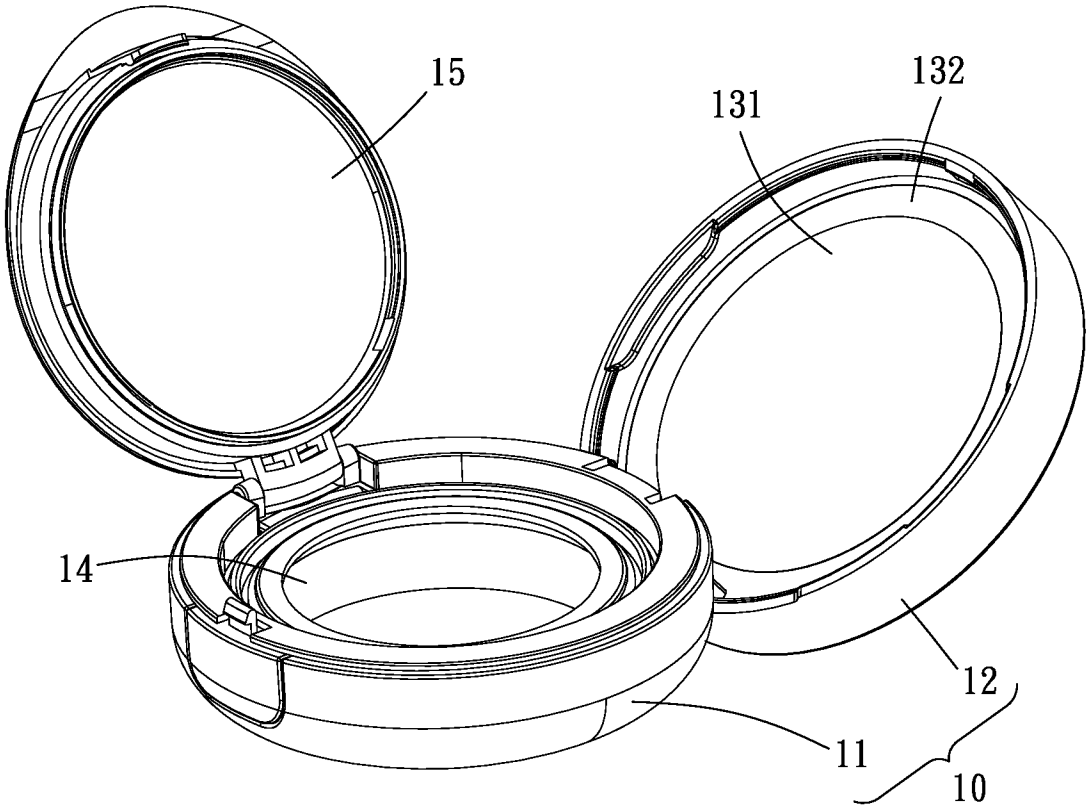
Figure 3:
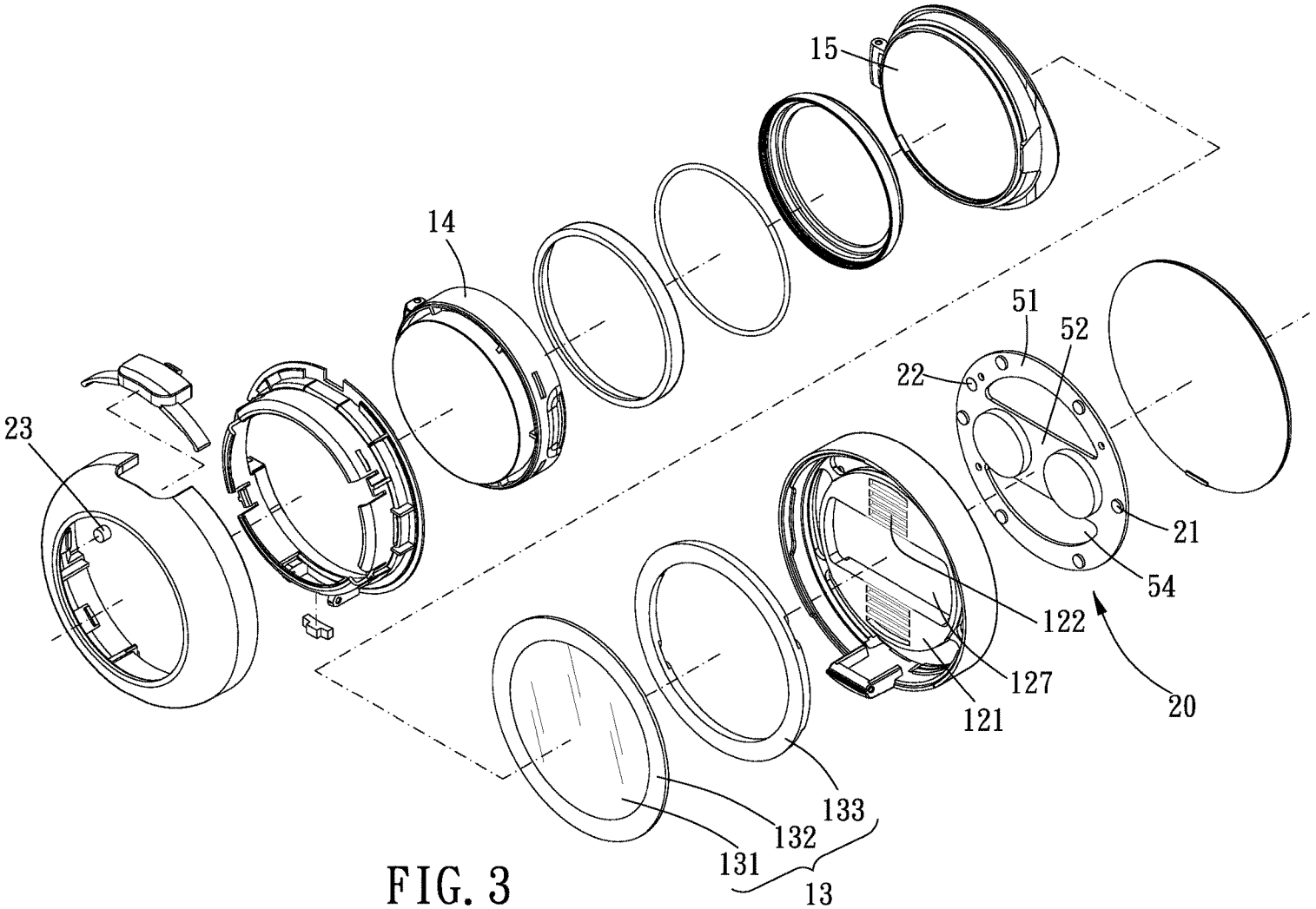
FIGS. 3 and 4 are breakdown drawings of a preferable embodiment of the present invention.
Figure 4:
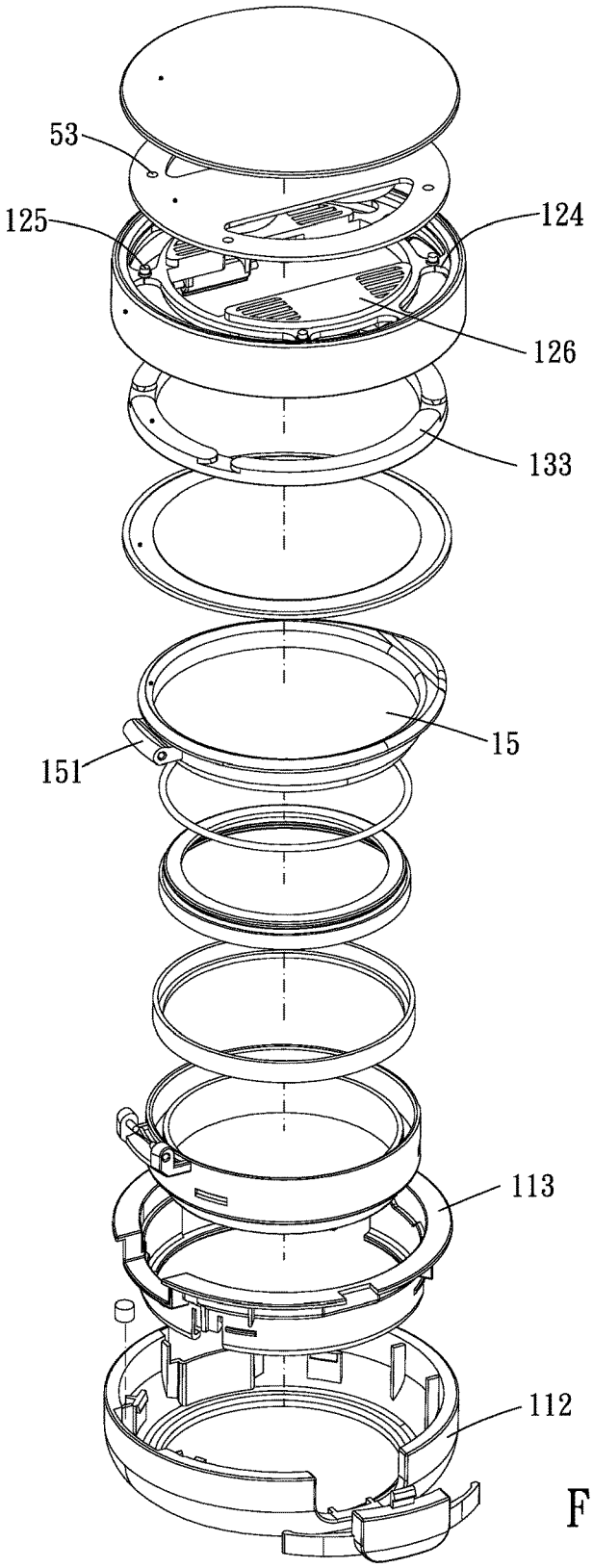
Figure 5:
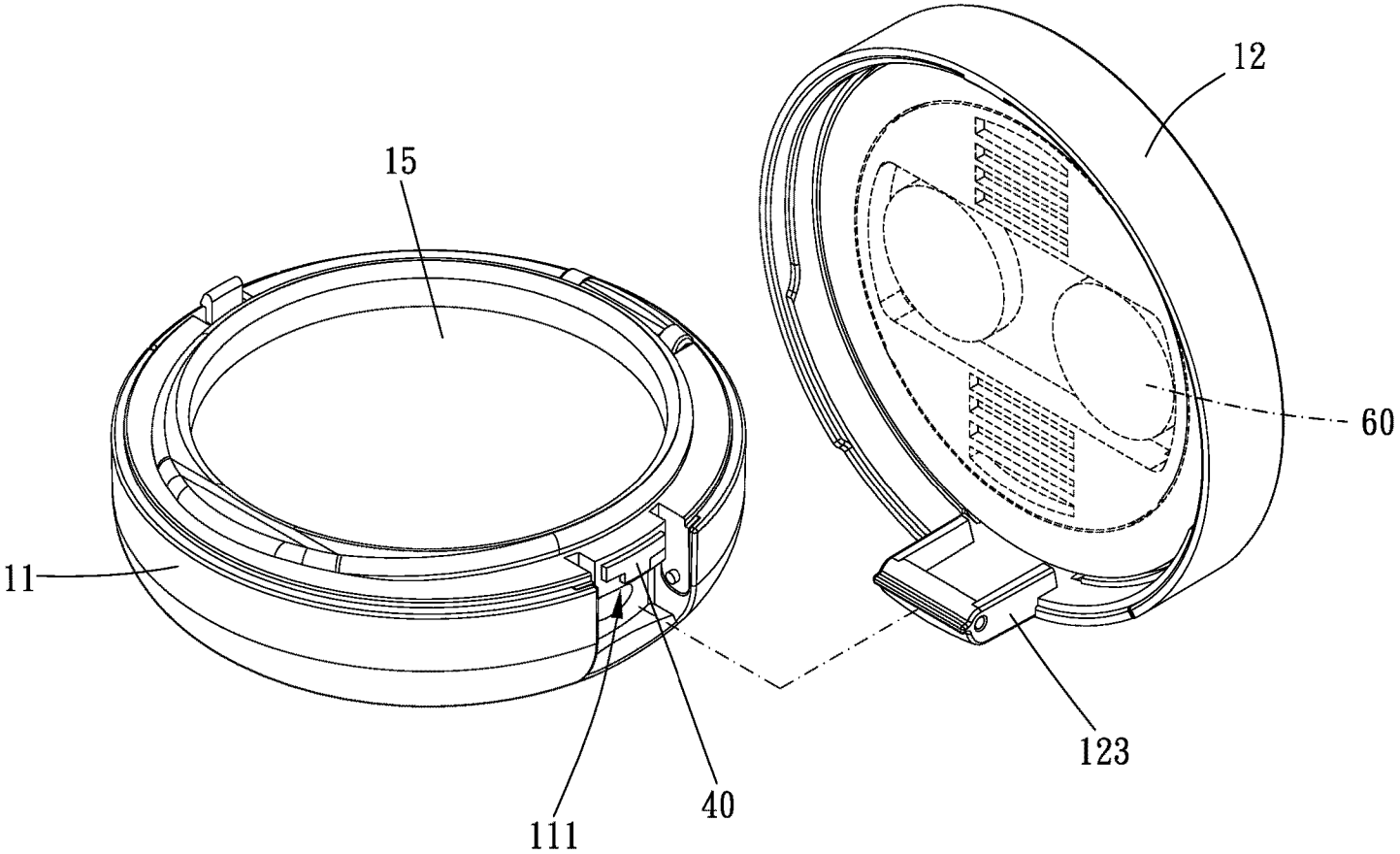
FIG. 5 is a partial breakdown drawing of a preferable embodiment of the present invention.
Figure 6:
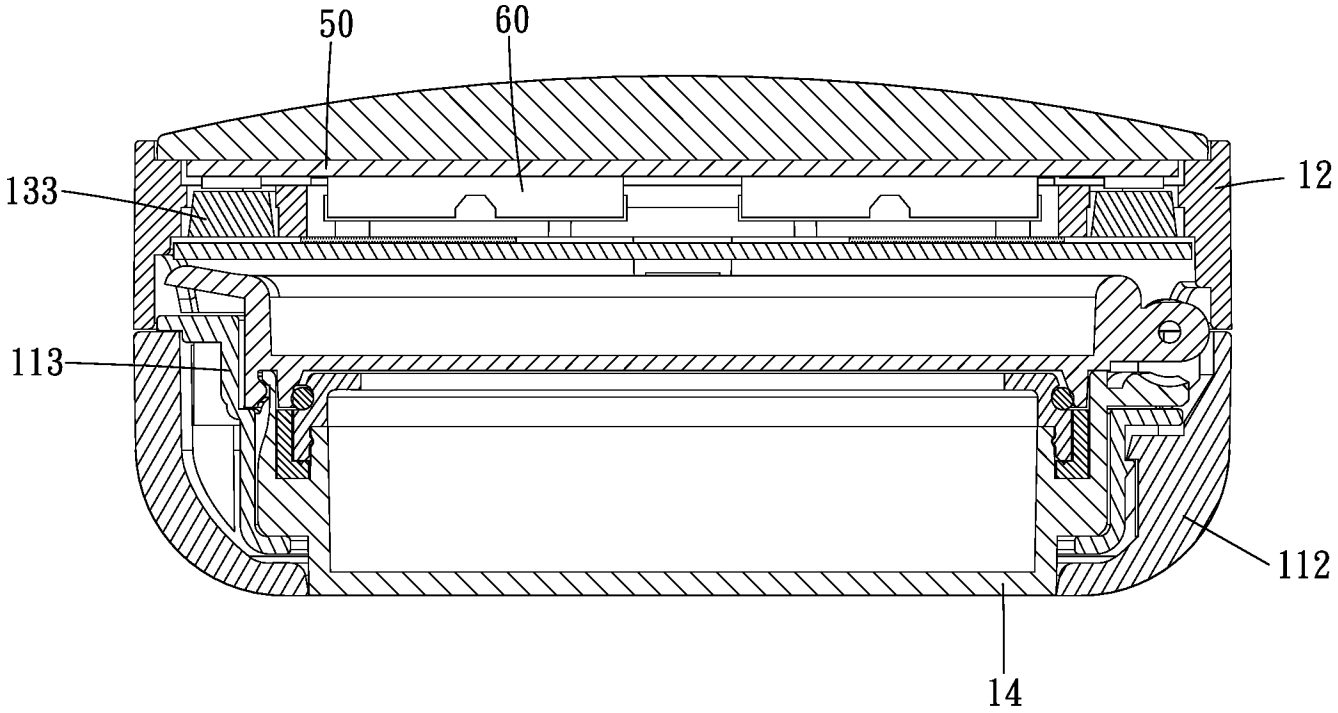
FIG. 6 is a cross-sectional view taken along line A-A of FIG. 1.
Figure 7:
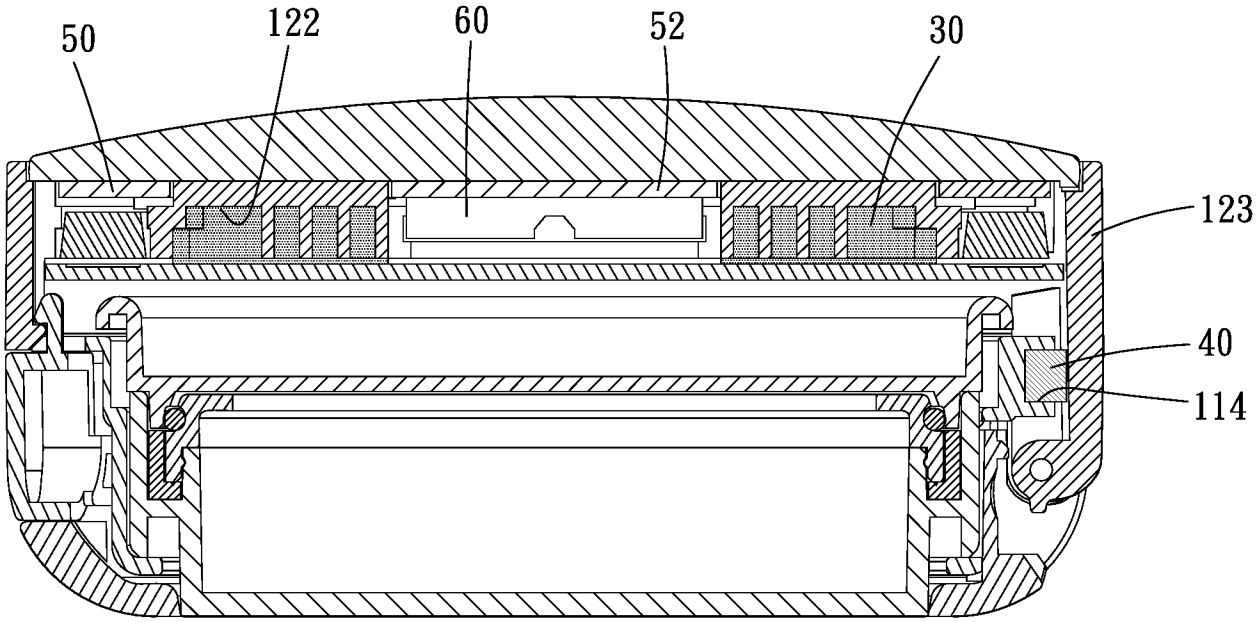
FIG. 7 is a cross-sectional view taken along line B-B of FIG. 1.
Figure 8:
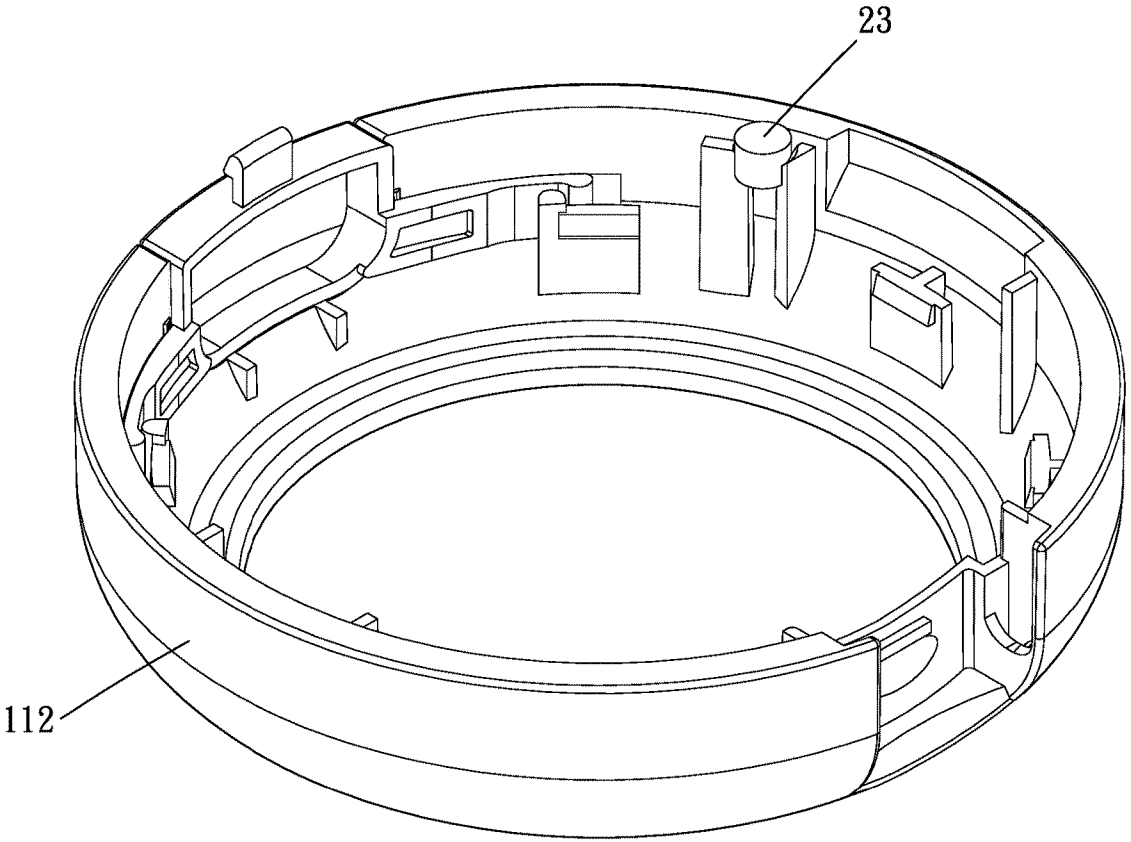
FIG. 8 is a stereogram of a housing of a preferable embodiment of the present invention.

Please refer to FIGS. 1 to 8 for a preferable embodiment of the present invention. A lightening cosmetic container 1 of the present invention includes a main body 10 and a lightening device 20.

The main body 10 includes a case 11, a cover 12 and an attachment member 13. The cover 12 has an inner surface 121 including at least one recession 122 disposed thereon. The attachment member 13 is attached to the inner surface 121 by an adhesive material 30 and covers at least part of the at least one recession 122 within which the adhesive material 30 comes so as to prevent leakage or overflow of the adhesive material 30. The lightening device 20 is disposed on the main body 10. The lightening device 20 includes at least one light source 21, a magnetic switch 22 which is electrically connected with the at least one light source 21, and a magnetic member 23 disposed corresponding to the magnetic switch 22. The cover 12 is openable relative to the case 11 to change magnetic state of the magnetic switch 22 and switch the magnetic switch 22 on. Therefore, the magnetic switch 22 is switchable when the cover 12 is opened or closed relative to the case 11.

The attachment member 13 includes a mirror portion 131 facing the case 11 and being attached to the inner surface 121, and the at least part of the at least one recession 122 is covered by the mirror portion 131. A number of the at least one recession 122 is preferably plural so as to receive redundant adhesive material 30 and avoid damaging other components.

The main body 10 further includes an inner containing member 14 and an inner lid 15 pivotally disposed on the inner containing member 14 so that inner spaces of the main body 10 are provided to receive respective objects. The cover 12 is pivotally disposed on the case 11, and the cover 12 and the inner lid 15 are swingable in directions perpendicular to each other. Specifically, the inner lid 15 includes pivoted arm 151 pivoted to the inner containing member 14 and the cover 12 further includes a connecting arm 123 which is pivoted to the case 11 and longer than the pivoted arm 151. The pivoted arm 151 and the connecting arm 123 are configured to extend substantially in directions perpendicular to each other when the case 11 is covered by the cover 12 so that the cover 12 and the inner lid 15 are openable without interfering with each other. The case 11 includes a receptacle 111 recessed laterally inwardly, and the connecting arm 123 is pivoted to and within the receptacle 111 so that the cover 12 is partially overlapped with the inner lid 15 when the case 11 is closed by the cover 12 so as to reduce thickness of the main body 10.

The case 11 includes a housing 112 and a connecting portion 113 detachably engaged with the housing 112. The housing 112 and the connecting portion 113 are ring members and the inner containing member 14 is detachably engaged annularly within the connecting portion 113 for easy repair and replacement. The magnetic member 23 is disposed between the housing 112 and the connecting portion 113, and the magnetic member 23 is not exposed so as to provide a preferable appearance.

The lightening cosmetic container 1 further includes at least one cushion 40 disposed between the case 11 and the cover 12. In this embodiment, the at least one cushion 40 is disposed within the receptacle 111 and abuttable against the connecting arm 123 so as to reduce collision between the cover 12 and the case 11 when the cover 12 is closed to the case 11. The receptacle 111 includes a mounting hole 114, and the cushion 40 is T-shaped and engaged partially within the mounting hole 114 so that the connecting arm 123 is effectively abuttable against an upper end of the cushion 40 which has a larger contact area. The cushion may be a rubber ring or block which is disposed on an interface of the cover and the case.

The attachment member 13 further includes a light permeable portion 132, and the lightening device 20 is disposed between the attachment member 13 and the cover 12. The at least one light source 21 correspondingly faces the light permeable portion 132 from which light of the at least one light source 21 radiates out. The light permeable portion 132 may be made of a material which is transparent or translucent, such as glass or plastic. Preferably, the light permeable portion 132 is disposed annularly along a periphery of the cover 12 to provide sufficient light. The attachment member 13 further includes a light guiding plate 133 which is disposed between the at least one light source 21 and the light permeable portion 132 so that light of the at least one light source 21 can pass through the light guiding plate 133 and radiate out uniformly.

The lightening cosmetic container 1 further includes a circuit board 50 which is electrically connected with the lightening device 20, wherein a number of the at least one light source 21 is plural and the plurality of light sources 21 are disposed corresponding to the light permeable portion 132. The circuit board 50 includes an annular plate 51 and a transverse plate 52 across the annular plate 51, and the circuit board 50 is θ-shaped for low cost and light weight. The plurality of light sources 21 are spacedly disposed on the annular plate 51 so that light of the plurality of light sources 21 are uniformly distributed. Moreover, the cover 12 further includes a plurality of arcuate slots 124 spacedly disposed therethrough and each of the plurality of light sources 21 is disposed within one of the arcuate slots 124 so that light of the plurality of light sources 21 can radiate to the attachment member 13. At least one power source 60 which is configured to be electrically connected with the plurality of light sources 21 is disposed on the transverse plate 52. The at least one power source may be an external power source and additionally connected to the lightening cosmetic container.

One of the circuit board 50 and the cover 12 has at least one concave portion, and the other of the circuit board 50 and the cover 12 has at least one projection which is insertable within the at least one concave portion. In this embodiment, the circuit board 50 has three of the concave portions 53 and the cover 12 has three of the projections 125 so that the circuit board 50 is positionably assembled to the cover 12 and the magnetic switch 22 corresponds to the magnetic member 23. Numbers of the concave portion and the projection may be changed according to requirements. The cover 12 further includes two protruding portions 126 disposed opposite to the inner surface 121 and away from the attachment member 13, and the circuit board 50 includes two receiving holes 54 within which the two protruding portions 126 are respectively disposed, which effectively reduce the thickness of the cover 12 and reach positioning effect. The cover 12 further includes a through hole 127 and the plurality of said recessions 122 are disposed by two corresponding sides of the through hole 127 to avoid leakage of the adhesive material 30. The through hole 127 is elongate and has a longitudinal axis, and the plurality of said recessions 122 are arranged in parallel and each parallel to the longitudinal axis of the through hole 127. The at least one power source 60 is received within the through hole 127 to reduce the thickness of the cover 12.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lightening cosmetic container, including:

a main body, including a case, a cover and an attachment member, the cover having an inner surface including at least one recession disposed thereon, the attachment member being attached to the inner surface by an adhesive material and covering at least part of the at least one recession within which the adhesive material comes;

a lightening device, disposed on the main body, including at least one light source, a magnetic switch which is electrically connected with the at least one light source, and a magnetic member disposed corresponding to the magnetic switch; wherein the cover is openable relative to the case to change magnetic state of the magnetic switch and switch the magnetic switch on.

2. The lightening cosmetic container of claim 1, wherein the attachment member includes a mirror portion facing the case and being attached to the inner surface, and the at least part of the at least one recession is covered by the mirror portion.

3. The lightening cosmetic container of claim 1, wherein the main body further includes an inner containing member and an inner lid pivotally disposed on the inner containing member, the cover is pivotally disposed on the case, and the cover and the inner lid are swingable in directions perpendicular to each other.

4. The lightening cosmetic container of claim 3, wherein the case includes a housing and a connecting portion detachably engaged with the housing, the housing and the connecting portion are ring members, and the inner containing member is detachably engaged annularly within the connecting portion.

5. The lightening cosmetic container of claim 4, wherein the magnetic member is disposed between the housing and the connecting portion.

6. The lightening cosmetic container of claim 1, further including at least one cushion disposed between the case and the cover.

7. The lightening cosmetic container of claim 1, wherein the case includes a receptacle recessed laterally inwardly, and the cover further includes a connecting arm which is pivoted to and within the receptacle.

8. The lightening cosmetic container of claim 7, further including at least one cushion disposed within the receptacle and abuttable against the connecting arm.

9. The lightening cosmetic container of claim 8, wherein the receptacle includes a mounting hole, and the cushion is T-shaped and engaged partially within the mounting hole.

10. The lightening cosmetic container of claim 3, wherein the inner lid includes pivoted arm pivoted to the inner containing member, the cover further includes a connecting arm which is pivoted to the case and longer than the pivoted arm, and the pivoted arm and the connecting arm are configured to extend substantially in directions perpendicular to each other when the case is covered by the cover.

11. The lightening cosmetic container of claim 1, wherein the attachment member further includes a light permeable portion, the lightening device is disposed between the attachment member and the cover, the at least one light source correspondingly faces the light permeable portion from which light of the at least one light source radiates out.

12. The lightening cosmetic container of claim 11, wherein the attachment member further includes a light guiding plate which is disposed between the at least one light source and the light permeable portion.

13. The lightening cosmetic container of claim 11, wherein the light permeable portion is disposed annularly along a periphery of the cover.

14. The lightening cosmetic container of claim 11, further including a circuit board which is electrically connected with the lightening device, wherein a number of the at least one light source is plural and the plurality of light sources are disposed corresponding to the light permeable portion.

15. The lightening cosmetic container of claim 14, wherein the circuit board includes an annular plate and a transverse plate across the annular plate, the circuit board is θ-shaped, the plurality of light sources are spacedly disposed on the annular plate, and at least one power source which is configured to be electrically connected with the plurality of light sources is disposed on the transverse plate.

16. The lightening cosmetic container of claim 14, wherein one of the circuit board and the cover has at least one concave portion, and the other of the circuit board and the cover has at least one projection which is insertable within the at least one concave portion.

17. The lightening cosmetic container of claim 15, wherein the cover further includes two protruding portions disposed opposite to the inner surface and away from the attachment member, and the circuit board includes two receiving holes within which the two protruding portions are respectively disposed.

18. The lightening cosmetic container of claim 15, wherein the cover further includes a through hole, a plurality of said recessions are disposed by two corresponding sides of the through hole, and the at least one power source is received within the through hole.

19. The lightening cosmetic container of claim 18, wherein the through hole is elongate and has a longitudinal axis, and the plurality of said recessions are arranged in parallel and each parallel to the longitudinal axis of the through hole.

20. The lightening cosmetic container of claim 19, wherein the attachment member includes a mirror portion facing the case and being attached to the inner surface, and the at least part of the at least one recession is covered by the mirror portion; the main body further includes an inner containing member and an inner lid pivotally disposed on the inner containing member, the cover is pivotally disposed on the case, and the cover and the inner lid are swingable in directions perpendicular to each other; the case includes a housing and a connecting portion detachably engaged with the housing, the housing and the connecting portion are ring members, and the inner containing member is detachably engaged annularly within the connecting portion; the magnetic member is disposed between the housing and the connecting portion; the lightening cosmetic container further includes at least one cushion disposed between the case and the cover; the case includes a receptacle recessed laterally inwardly, and the cover further includes a connecting arm which is pivoted to and within the receptacle; the at least one cushion is disposed within the receptacle and abuttable against the connecting arm; the receptacle includes a mounting hole, and the cushion is T-shaped and engaged partially within the mounting hole; the inner lid includes pivoted arm pivoted to the inner containing member, and the connecting arm is pivoted to the case and longer than the pivoted arm, and the pivoted arm and the connecting arm are configured to extend substantially in directions perpendicular to each other when the case is covered by the cover; the attachment member further includes a light guiding plate which is disposed between the at least one light source and the light permeable portion; the light permeable portion is disposed annularly along a periphery of the cover; the cover further includes a plurality of arcuate slots spacedly disposed therethrough and each of the plurality of light sources is disposed within one of the arcuate slots; the circuit board has at least one concave portion, and the cover has at least one projection which is insertable within the at least one concave portion; the cover further includes two protruding portions disposed opposite to the inner surface and away from the attachment member, and the circuit board includes two receiving holes within which the two protruding portions are respectively disposed.

* * * * *